US006909863B2

(12) United States Patent
Umezawa

(10) Patent No.: US 6,909,863 B2
(45) Date of Patent: Jun. 21, 2005

(54) SYSTEM AND METHOD FOR FIXING CONTROL IN AN IMAGE FORMING APPARATUS

(75) Inventor: Noriyuki Umezawa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 163 days.

(21) Appl. No.: 10/623,579

(22) Filed: Jul. 22, 2003

(65) Prior Publication Data

US 2005/0019050 A1 Jan. 27, 2005

(51) Int. Cl.[7] ..... G03G 15/20
(52) U.S. Cl. ..... 399/90; 399/69
(58) Field of Search ..... 399/51, 67, 69, 399/82, 88, 90

(56) References Cited

U.S. PATENT DOCUMENTS 5,621,511 A * 4/1997 Nakayama ..... 399/69
6,785,484 B2 * 8/2004 Nishiyama ..... 399/68
2002/0118977 A1 * 8/2002 Hasegawa et al. ..... 399/69
2003/0081961 A1 5/2003 Umezawa et al.
2004/0042809 A1 * 3/2004 Fuma et al. ..... 399/67
2004/0190924 A1 * 9/2004 Iwasaki et al. ..... 399/68
2004/0208664 A1 * 10/2004 Umezawa et al. ..... 399/67

FOREIGN PATENT DOCUMENTS

JP 8-307592 A 11/1996
JP 9-244474 A 9/1997

* cited by examiner

*Primary Examiner*—G. Bradley Bennett
(74) *Attorney, Agent, or Firm*—Foley & Lardner LLP

(57) ABSTRACT

A system and method for copying a plural-page document with an image forming apparatus, the image forming apparatus including a scanner for scanning each page of the document and a fixing unit for fixing images of each page of the document to a respective sheet, includes scanning each page of the document with the scanner, and determining whether the scanner is scanning any page of the document. A copy rate for copying the document is set to a first level if the scanner is scanning any page of the document, the copy rate corresponding to a number of pages copied in a set period of time. The copy rate is set to a second level higher than the first level if the scanner is not scanning any pages of the document.

22 Claims, 4 Drawing Sheets

SYSTEM AND METHOD FOR FIXING CONTROL IN AN IMAGE FORMING APPARATUS

FIELD OF THE INVENTION

The present invention relates generally to image processing and, more particularly, to a system and method for controlling a fixing operation in an image forming apparatus.

BACKGROUND OF THE INVENTION

In a conventional image forming apparatus, a photosensitive drum transfers a latent image from the drum to a paper document or other image receiving medium. A fixing unit or device fixes the image to the paper by applying heat to the paper. The fixing unit is supplied with electric power to generate the necessary heat to fix the image to the paper. This supply of electric power to the fixing unit is limited because of electric power used by other components of the image forming apparatus. For example, the supply of electric power to the fixing unit is diminished when the image forming apparatus is scanning an original image or document because the scanning unit uses some of the available supply of electric power. As a general result, the supply of electric power to the fixing unit is relatively low during scanning, and relatively high at other times (i.e., when not scanning).

To fix the image properly to the document, the electric power supplied to the fixing unit must generate sufficient heat to produce a sufficient fixing temperature. The fixing temperature may be affected by environmental conditions, such as a cool environment, as well as operational conditions, such as a user performing continuous copying. Under various conditions, continuing the printing or copying for an extended period of time may result in the supplied electric power being insufficient to generate the necessary heat for proper fixing. This leads to defective fixing.

To prevent such defective fixing, the fixing unit typically enters into a "wait" operation during image forming, which generally means that the actual printing waits for the necessary temperature rise/recovery in the fixing device. When the fixing unit goes into the wait operation, printing or copying operations are temporarily stopped, pending recovery of the fixing temperature of the fixing device. Such interruptions to copying and printing operations are disruptive to all users of the image forming apparatus.

SUMMARY OF THE INVENTION

Briefly, in one aspect of the invention, a method for copying a plural-page document with an image forming apparatus, the image forming apparatus including a scanner for scanning each page of the document and a fixing unit for fixing images of each page of the document to a respective sheet, includes scanning each page of the document with the scanner, and determining whether the scanner is scanning any page of the document. A copy rate for copying the document is set to a first level if the scanner is scanning any page of the document, the copy rate corresponding to a number of pages copied in a set period of time. The copy rate is set to a second level higher than the first level if the scanner is not scanning any pages of the document.

In another aspect of the invention, a method for copying a plural-page document with an image forming apparatus, the image forming apparatus including a scanner for scanning each page of the document and a fixing unit for fixing images of each page of the document to a respective sheet includes setting a first feed interval, feed interval corresponding to a distance between a trailing edge of a page and a leading edge of a subsequent page. A fixing temperature of the fixing unit for a current page is detected, the fixing temperature being a temperature at which the fixing unit fixes an image to a sheet of paper. The fixing temperature for the current page is compared to a first threshold value, and is compared to a fixing temperature for a prior page if the fixing temperature for the current page is not greater than the first threshold value. The feed interval is shortened from the first feed interval if the fixing temperature for the current page is greater than the fixing temperature for the prior page.

Further features, aspects and advantages of the present invention will become apparent from the detailed description of preferred embodiments that follows, when considered together with the accompanying figures of drawing.

DETAILED DESCRIPTION OF THE PREFERRED EMBODIMENT

Figure 1:
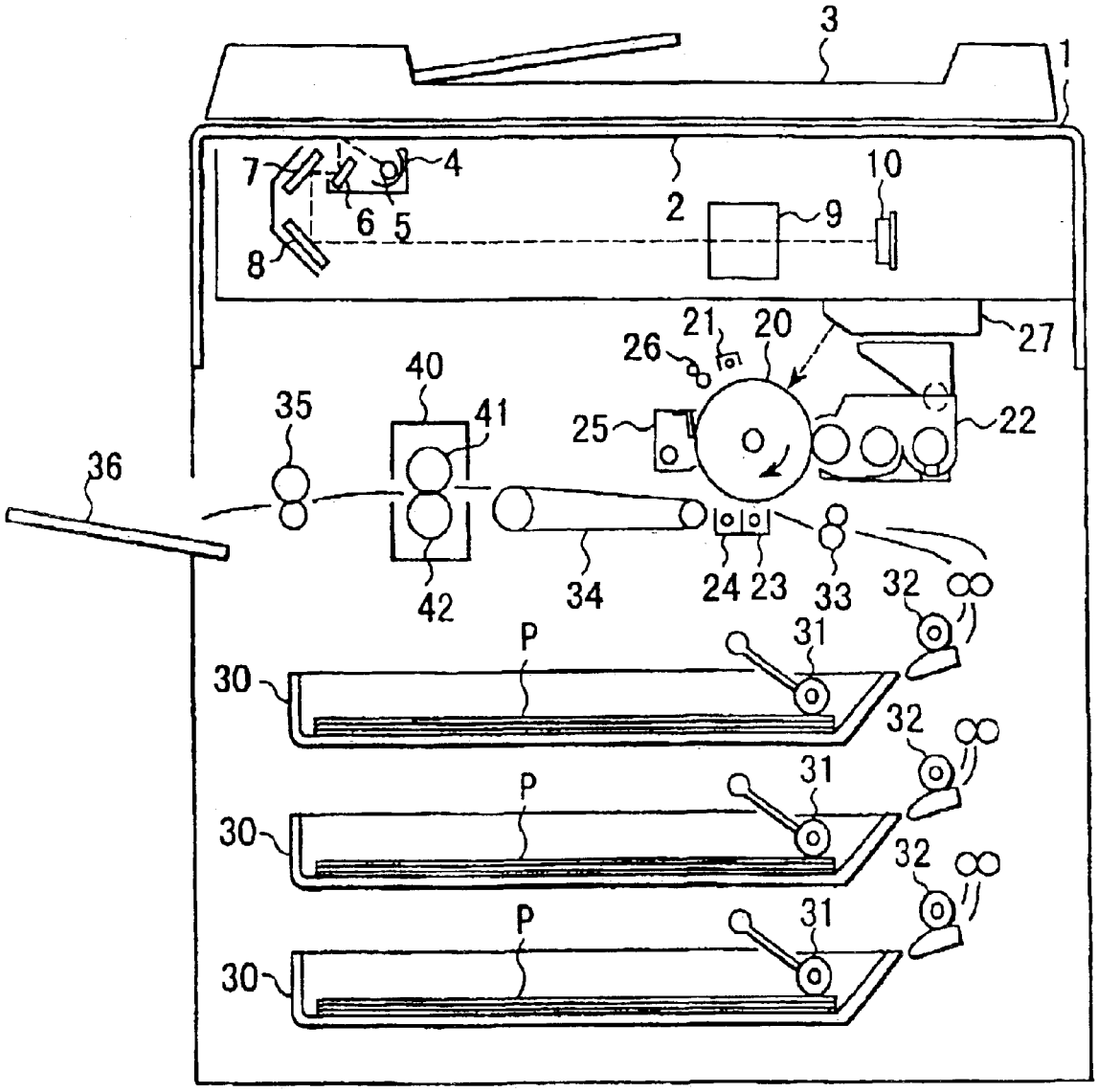
FIG. 1 is a structural diagram of an image forming apparatus consistent with the present invention.

FIG. 1 depicts a structural diagram of an image forming apparatus consistent with the present invention. As shown in FIG. 1, a document table 2 for placement of a page of a document is provided at an upper part of a main body 1. An automatic document feeder 3 is provided on the document table 2. The automatic document feeder 3 automatically feeds pages of the document one sheet at a time onto the upper surface of the document table 2.

A carriage 4 is reciprocally movably provided on the lower side of the document table 2. An exposure lamp 5 is provided on the carriage 4. The carriage 4 is reciprocally moved while the exposure lamp 5 is being turned on. Thus, the entire surface of the document table 2 is exposed and scanned.

The exposure scan obtains a reflection light image of the document page on the document table 2. The reflection light image is projected on a charge-coupled device (CCD) line sensor (CCD sensor) 10 via reflection mirrors 6, 7 and 8 and a magnification-variable lens block 9. The CCD sensor 10 outputs an image signal of a voltage level corresponding to a reception light amount. The image signal is supplied to a laser unit 27. The laser unit 27 emits a laser beam corresponding to the image signal.

A photosensitive drum 20 is rotatably provided within the main body 1. The photosensitive drum 20 is successively surrounded by an electrifying charger 21, a developing unit 22, a transfer charger 23, a separating charger 24, a cleaner 25, and a destaticizer 26. The laser beam emitted from the laser unit 27 is passed between the electrifying. charger 21 and developing unit 22 and strikes the peripheral surface of the photosensitive drum 20.

A plurality of sheet feed cassettes 30 are disposed at a bottom portion of the main body 1 and hold large amounts of copying sheets P serving as recording media. Each sheet feed cassette 30 is provided with a pick-up roller 31 for picking up copying sheets P one sheet at a time.

At the time of copying, copying sheets P are picked up one sheet at a time from any sheet feed cassette 30. A separator 32 separates the picked-up copying sheet P from the sheet feed cassette 30, and the paper is fed to a register roller 33. The copying sheet P waits in this area for rotation of the photosensitive drum 20, and in accordance with the timing rotating the photosensitive drum 20, the register roller 33 feeds the copying sheet P between the transfer charger 23 and photosensitive drum 20.

When the copying operation is performed, the photosensitive drum 20 rotates clockwise, as shown in FIG. 1. The electrifying charger 21 applies a high voltage supplied from a high voltage supply section (not shown) to the photosensitive drum 20, and electrifies the surface of the photosensitive drum 20 with electrostatic charge. An electrostatic latent image is formed on the photosensitive drum 20 by the electrification and the radiation of the laser beam from the laser unit 27 on the photosensitive drum 20.

The developing unit. 22 supplies a developer to the photosensitive drum 20. With the supply of the developer, the electrostatic latent image on the photosensitive drum 20 is changed to a visible image. The transfer charger 23 transfers the visible image (developer image) from the photosensitive drum 20 onto the copying sheet P fed from the register roller 33. The copying sheet P with the transferred image is separated from the photosensitive drum 20 by the separating charger 24. The separated copying sheet P is brought to a fixing unit 40 by a conveyor belt 34.

The fixing unit 40 comprises a heating roller 41 and a pressing roller 42. The copying sheet P is inserted between both rollers, and while the copying sheet P is being conveyed, the developer image on the copying sheet P is fixed by the heat of the heating roller 41. The-copying sheet P coming out of the fixing unit 40 is output to a tray 36 by conveyance rollers 35.

The heating roller 41 may be, for example, an endless member having a metal layer, which is constructed by an iron cylinder having a thickness of, for example, 1 mm. A mould-releasing layer of Teflon or similar material may be formed on the surface of the member. In addition, stainless steel, aluminum, an alloy of stainless steel or aluminum, or some other similar material may be used for the heating roller 41.

The pressing roller 42 may be constructed by coating elastic material such as silicon rubber, fluoro rubber, or some other similar material on the circumference of a core metal. The pressing roller 42 is pressed against the heating roller 41 at a predetermined pressure by a press mechanism, which provides a nip (where the outer circumferential surface of the pressing roller 42 is elastically deformed by a press contact) having a predetermined width at a position where both rollers contact each other. As a copying sheet P passes through the nip, toner on the copying sheet P is melted and fixed to the copying sheet P.

During the operation of the image forming apparatus, a temperature sensor, such as a thermistor, detects the temperature of the heating roller 41 of the fixing unit 40. The detected temperature of the heating roller 41, which corresponds to a fixing temperature for fixing the developer image to the copying sheet P, may be received by a main processing unit or processor, such as a CPU, which can serve as a control unit for controlling the operation of the components of the image forming apparatus. Based on the detected fixing temperature, the main processing unit can generate control signals for adjusting the fixing temperature of the heating roller 41. The fixing temperature adjustment is affected, in part, by the available supply of electric power to the fixing unit 40, and the heating roller 41 in particular. It should be recognized that various modifications or alternatives of the basic structure of the image forming apparatus may be achieved without departing from the basic relevant operation of the apparatus. The present invention is not limited to any particular structure.

Figure 2A:
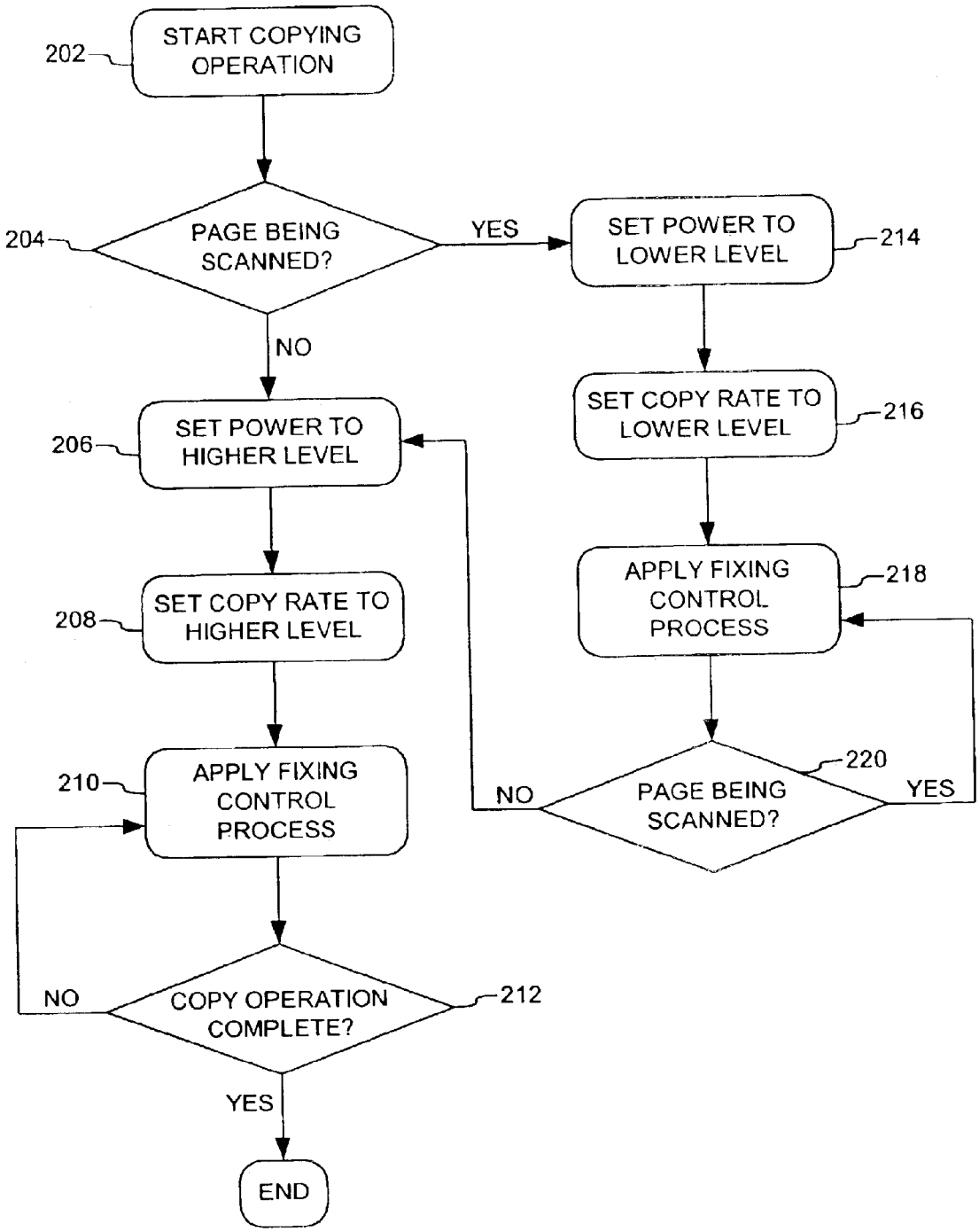
FIG. 2A is a flow diagram of a copy control process consistent with the present invention.

FIG. 2A is a flow diagram of a copy control process consistent with the present invention. As shown in FIG. 2A, a user first starts a copying operation (step 202). The copy operation is used to copy a document having one or more pages. The pages of the document can be placed on the document table 2 of the image forming apparatus individually by the user or automatically by an automatic document feeder (ADF).

For a copy operation, each document page is scanned by the exposure lamp 5, which generates a reflection light image of the original placed on the original table 2. The reflection light image is received by the CCD sensor 10, which outputs an image signal used to form an electrostatic latent image on the photosensitive drum 20. The developing unit 22 supplies developer to the photosensitive drum 20, changing the electrostatic latent image on the photosensitive drum 20 to a visible image, and the transfer charger 23 transfers the visible image (developer image) from the photosensitive drum 20 onto the copying sheet P. The copying sheet P with the transferred image is separated from the photosensitive drum 20 by the separating charger 24. The separated copying sheet P is brought to a fixing unit 40 by a conveyor belt 34, and the fixing unit 40 fixes the image to the copying sheet P.

During the copy operation, a check is made as to whether a page of the document is being scanned (step 204). The check can be made, for example, at a time when the register roller 33 feeds the copying sheet P and just before the image is formed on the copying sheet P. Typically, all pages of a document have completed being scanned before all the pages have been reproduced on copying sheets P. Accordingly, the fixing operations of the fixing unit 40 continue after the scanning process has been completed. The time between the end of the scanning process and the end of the fixing operations generally increases with the number of pages in the document and the number of copies of the documents being made.

The scanning process diminishes the amount of power available for the fixing unit 40 compared to the amount of power available for the fixing unit 40 when the scanning process is not being performed, i.e., has been completed. For example, while pages are being scanned, there may be 900 W available for the fixing unit 40 or more specifically for the heating roller 41, but 1000 W available when the scanning process is complete and a page is no longer being scanned. The difference is the amount of electric power needed by the image forming apparatus to perform the scanning process. The low power level of 900 W and high power level of 1000 W are exemplary values, and other values sufficient for performing the scanning process and fixing operations are possible.

If a page is being scanned, the power supplied to the fixing unit 40 is set to a predetermined lower level (step 214). The lower power level may be, for example, 900 W as described above. In addition to setting the power to the lower level, a copy rate is also set to a lower level (step 216). The copy rate is the number of copying sheets P generated in a set period of time. For the lower level, the copy rate can be, for example, 55 copies per minute (CPM). The copy rate for the lower level can be adjusted for varying conditions, such as the specific capabilities of the image forming apparatus and environmental conditions. The copy rate may also be affected by properties of the copy sheet P itself, including paper thickness and paper type such as normal paper or coated paper. A low copy rate means fewer fixing operations being performed by the fixing unit 40 in a set period of time as compared to the higher level.

Figure 2B:
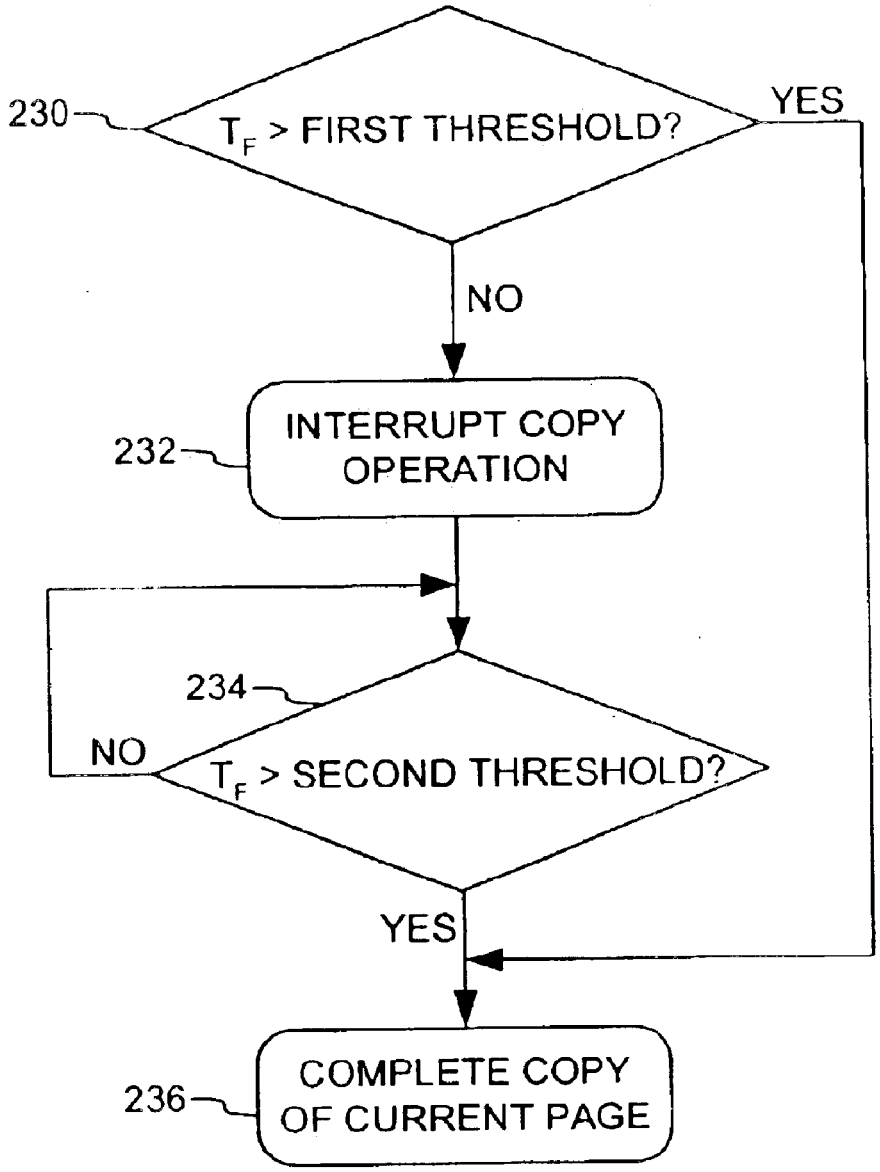
FIG. 2B is a flow diagram of a fixing control process consistent with the present invention.

After setting the power and copy rates to the lower levels, a fixing control process is performed (step 218). FIG. 2B is a flow diagram of a fixing control process consistent with the present invention. As shown in FIG. 2B, the fixing control process first compares a fixing temperature $T_F$ to a first threshold level (step 230). The fixing temperature $T_F$ corresponds to the detected temperature of the heating roller 41, which fixes the developer image to the copying sheet P. The fixing temperature $T_F$ can be detected by a sensor, such as a thermistor, and the detected fixing temperature $T_F$ can be received by a main processing unit. The first threshold level can be, for example, 160° C. The first threshold level is preferably set to a level corresponding approximately to a minimum fixing temperature $T_F$ sufficient to perform a fixing operation without defect.

If the fixing temperature $T_F$ is greater than the first threshold level, then the copying of the current page is completed (step 236). Completion of the copying of the current page includes the fixing unit 40 performing its fixing operation. If the fixing temperature $T_F$ is less than (or equal to) the first threshold level, then the copy operation is interrupted or stopped (step 232). The interruption or stopping of the copy operation is analogous to the wait operation described above. While the copy operation is stopped, the main processing unit of the image forming apparatus controls the fixing unit 40 to raise the fixing temperature $T_F$.

While being raised, the fixing temperature $T_F$ is compared to a second threshold level (step 234). The second threshold level is preferably at a higher level than the first threshold level, such as 180° C. If the fixing temperature $T_F$ is less than the second threshold level, then the copy operation continues to be interrupted. If the fixing temperature $T_F$ is greater than the second threshold level, then the copying of the current page is completed, in the same manner as described above when the fixing temperature $T_F$ is greater than the first threshold level (step 236).

As also described above, the first threshold level corresponds to the minimum fixing temperature $T_F$ for fixing an image to the copying sheet P without defect. Choosing the second threshold level to be higher than the first threshold level reduces the likelihood that the fixing temperature $T_F$ will soon fall below the first threshold level again, which in turn reduces the number of interruptions to the copy operation. In addition, with the copy rate set to the lower level during the scanning process, the fixing temperature $T_F$ drops more slowly than when the copy rate is set to a higher level, which may further reduce the number of interruptions of the copy operation.

Returning to FIG. 2A, after applying the fixing control process (step 218), a check is again made to determine if a page is being scanned (step 220). If so, then the fixing control process is again applied (step 218). If no page is being scanned, then the power level is set to a higher level (step 206). The higher power level can be, for example, 1000 W as described above. In addition to setting the power to the higher level, a copy rate is also set to a higher level (step 208). For the higher level, the copy rate can be, for example, 65 CPM. The copy rate for the higher level can be adjusted for varying conditions, such as the specific capabilities of the image forming apparatus and environmental conditions.

After setting the power and copy rate to the higher levels, the fixing control process is applied (step 210). The fixing control process is performed in the same manner as described above with respect to FIG. 2B. A check is then made to determine if the copy operation is complete (step 212). If not, the fixing control process is applied again (step 210). If the copy operation is complete, the copy process ends.

In the copy process of FIG. 2A, the process presumes that, if a page is not being scanned, then the scan process for all of the pages of the document has been completed. Under this assumption, once the power and copy rate are set to the higher levels, the settings stay the same until the copy operation is complete.

Alternatively, if there are periods during the scanning process that a page is not being scanned, then it is also possible for the power and copy rate settings to be adjusted between the lower and higher levels in accordance with each check to determine if a page is being scanned. The check to determine whether a page is being scanned continues to be performed so that it is possible to return to the lower level settings.

Figure 3:
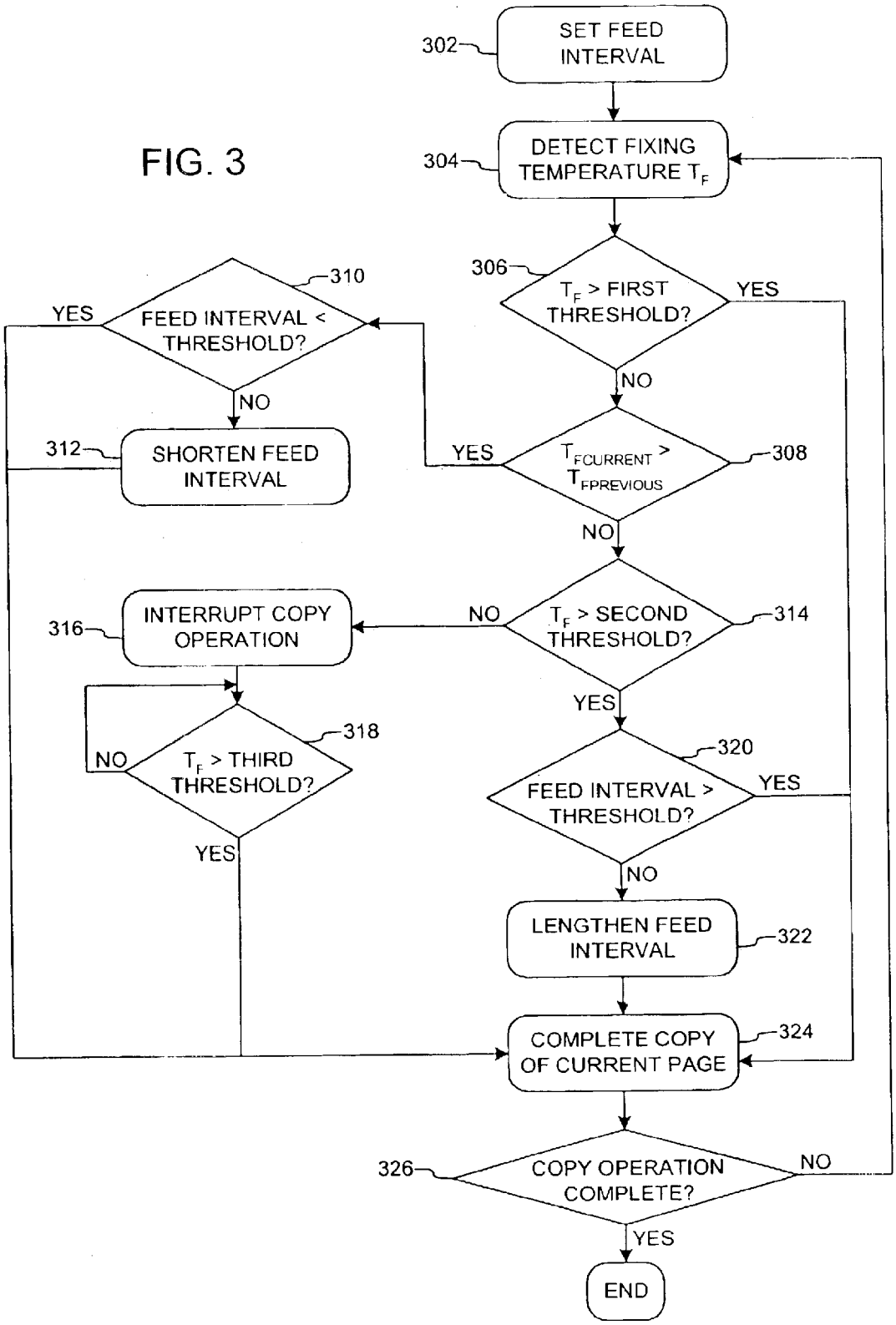
FIG. 3 is a flow diagram of another copy control process consistent with the present invention.

FIG. 3 is a flow diagram of another copy control process consistent with the present invention. As shown in FIG. 3, after a copy process is initiated, a feed interval is set (step 302). The feed interval corresponds to a distance between a trailing edge of a copying sheet P and a leading edge of a subsequent copying sheet P. The initial setting of the feed interval can be, for example, 230 mm. The particular setting of the feed interval can be adjusted in accordance with the capabilities of the image forming apparatus and any other factor that may affect the feed interval.

The feed interval can be controlled by the main processing unit of the image forming apparatus, such as by controlling the time between copying sheets P being loaded from the sheet feed cassette 30, by controlling the rate at which copying sheets P pass through the image forming apparatus. The actual adjustment of the feed interval can be controlled by the rotation of the register roller 33. In the copy process, the copying sheet P from the sheet feed cassette 30 is stopped at the register roller 33, which aligns the leading edge of the copying sheet P. When the register roller 33 starts to rotate, it feeds the copying sheet P between the transfer charger 23 and photosensitive drum 20. Control of the feed interval can be effected by controlling the start timing of the rotation of the register roller. Starting the rotation of the register roller 33 earlier shortens the feed interval, while delaying the rotation lengthens the feed interval.

In addition to setting the feed interval, the fixing temperature is detected for the current page ($T_{FCURRENT}$) being copied (step 306). The fixing temperature $T_{FCURRENT}$ is detected by a sensor, such as a thermistor, and the detected fixing temperature $T_{FCURRENT}$ can be received by the main processing unit. The fixing temperature $T_{FCURRENT}$ is then compared to a first threshold level (step 308). The first threshold level can be, for example, 180° C. or some other temperature that is some value higher than a minimum temperature sufficient to avoid defects when fixing the image to the copying sheet P.

If the fixing temperature $T_{FCURRENT}$ is greater than the first threshold level, then copying of the current page is completed (step 326). The completion of the copying of the current page includes the fixing operation performed by the fixing unit 40. If, however, the fixing temperature $T_{FCURRENT}$ for the current page is less (or equal to) than the first threshold level at step 306, then a check is made to determine if the fixing temperature for the current page $T_{FCURRENT}$ is greater than the fixing temperature for the previous page ($T_{FPREVIOUS}$) (step 308). The fixing temperature for the previous page $T_{FPREVIOUS}$ corresponds to the fixing temperature detected when the previous page was being copied.

If the fixing temperature for the current page $T_{FCURRENT}$ is greater than the fixing temperature for the previous page $T_{FPREVIOUS}$, then a check is made to determine if the feed interval has reached a feed interval limit (step 310). The feed interval limit may correspond to a minimum feed interval and be set to a value of, for example, 150 mm. The actual value for the feed interval limit can be set in accordance with the capabilities of the image forming apparatus. If the feed interval is less (or equal to) the feed limit, then the copy operation is completed without changing the feed interval (step 324). If the feed interval is greater than the feed interval limit, then the feed interval is shortened (step 312). The feed interval can be shortened by a predetermined amount, such as 10 mm. For example, if the initial setting for the feed interval is 230 mm, then the feed interval may be shortened to 220 mm. After shortening the feed interval, copying of the current page is then completed (step 324).

If the fixing temperature for the current page $T_{FCURRENT}$ is less than (or equal to) the fixing temperature for the previous page $T_{FPREVIOUS}$, then the fixing temperature for the current page $T_{FCURRENT}$ is compared to a second threshold level (step 314). The second threshold level is preferably at a value lower than the first threshold level, such as 160° C. or some other temperature that is approximately a minimum temperature sufficient to avoid defects when fixing the image to the copying sheet P.

If the fixing temperature for the current page $T_{FCURRENT}$ is less than (or equal to) the second threshold level, then the copy operation is interrupted (step 316). The interruption of the copy operation is effected in the same manner as the interruption in the fixing control process of FIG. 2B. After interrupting the copy operation, the fixing temperature for the current page $T_{FCURRENT}$ is periodically compared to a third threshold level (step 318). The third threshold level is preferably at a higher level than the second threshold level, such as 180° C. If the fixing temperature $T_{FCURRENT}$ is less than the third threshold level, then the copy operation continues to be interrupted. However, if the fixing temperature $T_{FCURRENT}$ is greater than the third threshold level, then the copying of the current page is completed (step 324).

If the fixing temperature for the current page $T_{FCURRENT}$ is greater than the second threshold level, then a check is made to determine if the feed interval has reached a feed interval limit (step 320). The feed interval limit may correspond to a maximum feed interval and be set to a value of, for example, 300 mm. The actual value for the feed interval limit can be set in accordance with the capabilities of the image forming apparatus. If the feed interval has reached the feed interval limit, then the copying of the current page is completed at that feed interval limit (step 324).

However, as long as the feed interval is less than the feed interval limit (i.e., the ceiling) by at least a predetermined amount, then the feed interval is lengthened (step 322). The feed interval can be lengthened by the predetermined amount, such as 10 mm. For example, if the feed interval is 230 mm, then the feed interval may be lengthened to 240 mm. If the feed interval is less than the feed interval limit by something less than the so-called predetermined amount, the feed interval can be lengthened to equal the feed interval limit. The copying of the current page is then completed (step 324).

After completing the copy of the current page, a check is made to determine if the copy operation is complete (step 326). If there are more pages remaining to copy, then the process of steps 304 to 324 are repeated. If the copy operation is complete, the copy process ends.

In the copy process of FIG. 3, the feed interval is adjusted to compensate for changes in the fixing temperature $T_{FCURRENT}$, which makes it possible to minimize the number of interruptions to the copy operation. When the fixing temperature $T_{FCURRENT}$ is greater than the first threshold, which is a relatively higher temperature threshold, copying continues at the set feed interval. If the temperature is less than this first threshold, then the fixing temperature for the current page $T_{FCURRENT}$ being copied is compared to the fixing temperature for the previous page $T_{FPREVIOUS}$. If the fixing temperature for the current page $T_{FCURRENT}$ is higher, the fixing temperature is rising, and the feed interval can be shortened, which increases the rate at which copies are produced. The rise of the fixing temperature $T_{FCURRENT}$ indicates that the fixing temperature is moving further away from the minimum temperature necessary to avoid fixing defects, which allows the feeding interval to be shortened.

If the fixing temperature for the current page $T_{FCURRENT}$ is lower, however, then it is compared to the second threshold, which is a lower temperature threshold If it is lower than the second threshold, copying is interrupted or stopped until the fixing temperature $T_{FCURRENT}$ rises above the third threshold, which is a higher temperature threshold. This interruption works in the same manner as the fixing control process of FIG. 2B. By waiting until for the fixing temperature $T_{FCURRENT}$ to rise above the third threshold, it becomes less likely for a copy interruption to occur again soon thereafter.

If the fixing temperature $T_{FCURRENT}$ is greater than the second threshold, the feed interval is compared to the feed interval limit. If the feed interval is less than the feed interval limit by at least a predetermined amount, the feed interval is lengthened by the predetermined amount, which decreases the rate at which copies are produced. The feed interval may be possibly lengthened in response to an indication that the fixing temperature is falling (based on the fixing temperature for the current page $T_{FCURRENT}$ being lower than the fixing temperature for the previous page $T_{FPREVIOUS}$), which implies that the fixing temperature $T_{FCURRENT}$ is moving toward the minimum temperature necessary to avoid fixing defects. By lengthening the feed interval, the decline in the fixing temperature $T_{FCURRENT}$ is slowed, which delays or avoids the need to interrupt the copy operation.

In the copy process of FIG. 3, if the fixing temperature $T_{FCURRENT}$ is greater than the first threshold, the copying of the current page is completed, but no adjustment is made to the feed interval. It is possible to modify the copy process so that the feed interval is shortened if the fixing temperature $T_{FCURRENT}$ is greater than the first threshold. Other modifications of the copy process of FIG. 3 can be made that increase the speed in which the copy operation is completed but that minimize interruptions due to the fixing temperature $T_{FCURRENT}$ falling below a temperature sufficient to fix images without defects.

The foregoing description of preferred embodiments of the invention has been presented for purposes of illustration and description. It is not intended to be exhaustive or to limit the invention to the precise form disclosed, and modifications and variations are possible in light in the above teachings or may be acquired from practice of the invention. The embodiments were chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. A method for copying a plural-page document with an image forming apparatus, the image forming apparatus including a scanner for scanning each page of the document and a fixing unit for fixing images of each page of the document to a respective sheet, comprising:

scanning each page of the document with the scanner;

determining whether the scanner is scanning any page of the document;

setting a copy rate for copying the document to a first level if the scanner is scanning any page of the document, the copy rate corresponding to a number of pages copied in a set period of time; and setting the copy rate to a second level higher than the first level if the scanner is not scanning any pages of the document.

2. A method according to claim 1, further comprising:

supplying a first amount of power to the fixing unit if the scanner is scanning any page of the document; and supplying a second amount of power, higher than the first amount of power, to the fixing unit if the scanner is not scanning any pages of the document.

3. A method according to claim 2, further comprising:

detecting a fixing temperature of the fixing unit, the fixing temperature being a temperature at which the fixing unit fixes an image to a sheet of paper;

comparing the fixing temperature to a first threshold value;

temporarily stopping the copy of the document if the fixing temperature is less than the first threshold value;

comparing the fixing temperature to a second threshold value greater than the first threshold value; and restarting the copying of the document when the fixing temperature becomes greater than the second threshold value.

4. A method according to claim 1, further comprising:

detecting a fixing temperature of the fixing unit, the fixing temperature being a temperature at which the fixing unit fixes an image to a sheet of paper;

comparing the fixing temperature to a first threshold value; and temporarily stopping the copy of the document if the fixing temperature is less than the first threshold value.

5. A method according to claim 4, further comprising:

comparing the fixing temperature to a second threshold value greater than the first threshold value; and restarting the copying of the document when the fixing temperature becomes greater than the second threshold value.

6. A method for copying a plural-page document with an image forming apparatus, the image forming apparatus including a scanner for scanning each page of the document and a fixing unit for fixing images of each page of the document to a respective sheet, comprising:

setting a first feed interval, feed interval corresponding to a distance between a trailing edge of a page and a leading edge of a subsequent page;

detecting a fixing temperature of the fixing unit for a current page, the fixing temperature being a temperature at which the fixing unit fixes an image to a sheet of paper;

comparing the fixing temperature for the current page to a first threshold value;

comparing the fixing temperature for the current sheet to a fixing temperature for a prior page if the fixing temperature for the current page is not greater than the first threshold value; and shortening the feed interval from the first feed interval if the fixing temperature for the current page is greater than the fixing temperature for the prior page.

7. A method according to claim 6, further comprising comparing the fixing temperature for the current page to a second threshold value, the second threshold value being less than the first threshold value, if the fixing temperature for the current sheet is not greater than the fixing temperature for the prior sheet; and stopping the copying of the document if the fixing temperature for the current sheet is not greater than the second threshold value.

8. A method according to claim 7, further comprising:

comparing the fixing temperature for the current sheet to a third threshold value greater than the second threshold value if the fixing temperature for the current sheet is not greater than the second threshold value; and completing the fixing of the current page if the fixing temperature for the current page is greater than the third threshold value.

9. A method according to claim 7, further comprising:

comparing the first feed interval to a maximum feed interval limit;

increasing the feed interval from the first feed interval by a predetermined amount if the first feed interval is less than the maximum feed interval limit.

10. A method according to claim 9, further comprising completing the fixing of the current page at the increased feed interval if the fixing temperature for the current page is greater than or equal to the maximum feed interval threshold value.

11. A method according to claim 6, further comprising completing the fixing of the current page if the fixing temperature for the current page is greater than the first threshold value.

12. An image forming apparatus for copying a plural-page document, comprising:

a scanner that scans each page of the document a control unit configured to determine whether the scanner is scanning any page of the document, set a copy rate for copying the document to a first level if the scanner is scanning any page of the document, the copy rate corresponding to a number of pages copied in a set period of time, and set the copy rate to a second level higher than the first level if the scanner is not scanning any pages of the document; and a fixing unit that fixes images of each page of the document to a respective sheet.

13. An image forming apparatus according to claim 12, wherein a first amount of power is supplied to the fixing unit if the scanner is scanning any page of the document, and a second amount of power, higher than the first amount of power, is supplied to the fixing unit if the scanner is not scanning any pages of the document.

14. An image forming apparatus according to claim 13, further comprising:

a sensor that detects a fixing temperature of the fixing unit, the fixing temperature being a temperature at which the fixing unit fixes an image to a sheet of paper, wherein the control unit is further configured to compare the fixing temperature to a first threshold value, temporarily stop the copy of the document if the fixing temperature is less than the first threshold value, comparing the fixing temperature to a second threshold value greater than the first threshold value, and restart the copying of the document when the fixing temperature becomes greater than the second threshold value.

15. An image forming apparatus according to claim 12, further comprising:

a sensor that detects a fixing temperature of the fixing unit, the fixing temperature being a temperature at which the fixing unit fixes an image to a sheet of paper, wherein the control unit is further configured to compare the fixing temperature to a first threshold value, and temporarily stop the copy of the document if the fixing temperature is less than the first threshold value.

16. An image forming apparatus according to claim 15, the control unit further configured to compare the fixing temperature to a second threshold value greater than the first threshold value, and restart the copying of the document when the fixing temperature becomes greater than the second threshold value.

17. An image forming apparatus for copying a plural-page document, comprising:

a scanner that scans each page of the document;

a fixing unit that fixes images of each page of the document to a respective sheet;

a sensor that detects a fixing temperature of the fixing unit for a current page, the fixing temperature being a temperature at which the fixing unit fixes an image to a sheet of paper;

a control unit configured to compare the fixing temperature for the current page to a first threshold value, compare the fixing temperature for the current sheet to a fixing temperature for a prior page if the fixing temperature for the current page is not greater than the first threshold value, set a first feed interval, feed interval corresponding to a distance between a trailing edge of a page and a leading edge of a subsequent page, and shorten the feed interval from the first feed interval if the fixing temperature for the current page is greater than the fixing temperature for the prior page.

18. An image forming apparatus according to claim 17, the control unit further configured to compare the fixing temperature for the current page to a second threshold value, the second threshold value being less than the first threshold value, if the fixing temperature for the current sheet is not greater than the fixing temperature for the prior sheet, and stop the copying of the document if the fixing temperature for the current sheet is not greater than the second threshold value.

19. An image forming apparatus according to claim 18, the control unit further configured to compare the fixing temperature for the current sheet to a third threshold value greater than the second threshold value if the fixing temperature for the current sheet is not greater than the second threshold value, and complete the fixing of the current page if the fixing temperature for the current page is greater than the third threshold value.

20. An image forming apparatus according to claim 18, the control unit further configured to compare the first feed interval to a maximum feed interval limit, and increase the feed interval from the first feed interval by a predetermined amount if the first feed interval is less than the maximum feed interval limit.

21. An image forming apparatus according to claim 20, the control unit further configured to complete the fixing of the current page at the increased feed interval if the fixing temperature for the current page is greater than or equal to the maximum feed interval threshold value.

22. An image forming apparatus according to claim 17, the control unit further configured to complete the fixing of the current page if the fixing temperature for the current page is greater than the first threshold value.

* * * * *